US006346015B2

(12) United States Patent
Yoshida et al.

(10) Patent No.: US 6,346,015 B2
(45) Date of Patent: Feb. 12, 2002

(54) TERMINAL HAVING RETAINING PIECE FOR HOLDING TERMINAL IN HOUSING

(75) Inventors: Haruki Yoshida; Motohisa Kashiyama, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/731,977

(22) Filed: Dec. 8, 2000

(30) Foreign Application Priority Data

Dec. 8, 1999 (JP) ..... 11-348496

(51) Int. Cl.[7] ..... H01R 11/22
(52) U.S. Cl. ..... 439/850; 439/842
(58) Field of Search ..... 439/842, 845, 439/849, 850, 851, 852

(56) References Cited

U.S. PATENT DOCUMENTS

| | | | | | |
|---|---|---|---|---|---|
| 3,729,701 | A | * | 4/1973 | Smith | 439/858 |
| 4,579,409 | A | * | 4/1986 | Enneper et al. | 439/266 |
| 4,934,966 | A | * | 6/1990 | D'Urso | 439/849 |
| 5,281,178 | A | * | 1/1994 | Biscorner | 439/845 |
| 5,295,874 | A | | 3/1994 | Yoneda et al. | 439/850 |
| 5,470,258 | A | | 11/1995 | Suzuki et al. | 439/595 |
| 5,733,154 | A | * | 3/1998 | Libregts | 439/850 |
| 5,839,914 | A | | 11/1998 | Watanbe et al. | 439/488 |
| 6,039,615 | A | * | 3/2000 | Suzuki | 439/849 |

FOREIGN PATENT DOCUMENTS

| | | | |
|---|---|---|---|
| DE | 43 11 352 A1 | 10/1993 | |
| JP | 6-33373 | 4/1994 | ..... H01R/13/115 |

* cited by examiner

*Primary Examiner*—Tulsidas Patel
(74) *Attorney, Agent, or Firm*—Sughrue Mion, PLLC

(57) ABSTRACT

A terminal (1) has resilient curl portions (3, 3) integrally formed respectively on opposite side edges of a base plate portion (2), each of the resilient curl portions (3, 3) being inwardly bent into a generally mountain-like cross-sectional shape. Retaining piece portions (5, 5) are integrally formed respectively on the resilient curl portions (3, 3), and the retaining piece portions (5, 5) have flat surfaces, respectively, which are spaced a desired distance at least from the base plate portion (2) in generally parallel relation thereto, and one end (15) of each of the retaining piece portions, forming part of a contour thereof, is engageable with a retaining member (23) formed on a connector housing (20) for receiving the terminal.

4 Claims, 3 Drawing Sheets

TERMINAL HAVING RETAINING PIECE FOR HOLDING TERMINAL IN HOUSING

BACKGROUND OF THE INVENTION

1. Field of the Invention

The present invention relates to a female terminal having resilient curl portions of a generally mountain-like cross-sectional shape integrally formed respectively on opposite side edges of a base plate portion.

The present application is based on Japanese Patent Application No. Hei. 11-348496, which is incorporated herein by reference.

2. Description of the Related Art

A connector, used for connecting vehicle's wire harnesses or the like together, comprises a plurality of electrically-conductive terminals, and a connector housing of a synthetic resin for receiving the plurality of terminals. Each terminal, received in the connector housing, is retained against withdrawal by a retaining member provided in the connector housing.

One female terminal for connection to a male tab-like terminal has the following construction.

Namely, this female terminal is formed by an electrically-conductive metal sheet, and a pair of resilient curl portions are formed on a front portion of a base plate portion of the terminal, and conductor clamping portions and sheath clamping portions for a wire are formed on a rear portion of the base plate portion.

The pair of resilient curl portions, each bent into a generally mountain-like cross-sectional shape, are integrally formed respectively on opposite side edges of the base plate portion, and the male tab-like terminal can be inserted into a space, formed by the resilient curl portions, from front ends thereof toward rear ends thereof, to be connected to the resilient curl portions. A retaining member, formed on a connector housing, can engage the rear ends of the resilient curl portions in such a manner that the retaining member is slightly elastically deformed. A distal end portion of the retaining member can rest on and engage inner slanting surfaces of the pair of resilient curl portions (The same condition occurs in the case of curved surfaces).

In the above related female terminal, the resilient curl portions have a generally mountain-like cross-sectional shape, and therefore the amount of displacement of the distal end portion of the elastically-deformed retaining member, engaged with the rear ends of the resilient curl portions, is liable to be varied because of the adjustment of an inserting force (required for inserting the terminal into the connector housing) and a load of contact of the terminal with the male tab-like terminal.

As a result, an inspecting process, which is effected by the use of a connector inspecting instrument so as to detect a half-inserted condition of the terminal in accordance with the position of the retaining member in its engaged condition, is affected.

SUMMARY OF THE INVENTION

The present invention has been made under the above circumstances, and an object of the present invention is to provide a terminal designed to stabilize the amount of displacement of a retaining member.

To achieve the above object, according to the first aspect of the present invention, there is provided a metal terminal of a female type, which comprises a base plate portion, an electrical contact portion, to which a mating male tab-like terminal is connectable, formed on the base plate portion, the electrical contact portion including resilient curl portions which extend from opposite side edges of the base plate portion, and are inwardly bent to form curls thereof, and retaining piece portions integrally formed respectively on the resilient curl portions, the retaining piece portions having surfaces which are spaced a desired distance at least from the base plate portion in generally parallel relation thereto, wherein one ends of the retaining piece portions, partially forming respective contours of the resilient curl portions, are engageable with a retaining member of a connector housing which is receivable the terminal. In the present invention, when the terminal is received in the connector housing, the elastically-deformed retaining member engages the one ends of the retaining piece portions. Also, the retaining member rests on the surfaces of the retaining piece portions disposed parallel to the base plate portion. The retaining piece portions are spaced the desired distance from the base plate portion, and therefore the amount of displacement of the retaining member before and after the engagement with the retaining piece portions is stabilized. By thus stabilizing the displacement amount, the detection of a half-inserted condition of the terminal can be positively effected by a connector inspecting instrument. With respect to the mating male tab-like terminal, it may be extended in the electrical contact portion from front ends toward rear ends of the resilient curl portions when connecting to the electrical contact portion. Each of the resilient curl portions may have a generally mountain-like shape in a cross section thereof.

According to the second aspect of the present invention, it is preferable that the one ends of the retaining piece portions and rear ends of the resilient curl portions are disposed in a common plane. In this case, when the terminal is received in the connector housing, the position of engagement of the retaining member is the same as in the related construction. Therefore, the structure of the connector housing does not need to be changed.

According to the third aspect of the present invention, it is preferable that the one ends of the retaining piece portions are continuous with the rear ends of the resilient curl portions. In this case, the retaining piece portions can be relatively easily formed integrally on the resilient curl portions, respectively. For example, each retaining piece portion can be easily formed by stamping a piece portion (including the rear end of the resilient curl portion) from the resilient curl portion and bending it.

DETAILED DESCRIPTION OF THE PREFERRED EMBODIMENT

One preferred embodiment of the present invention now will be described with reference to the drawings.

Figure 1:
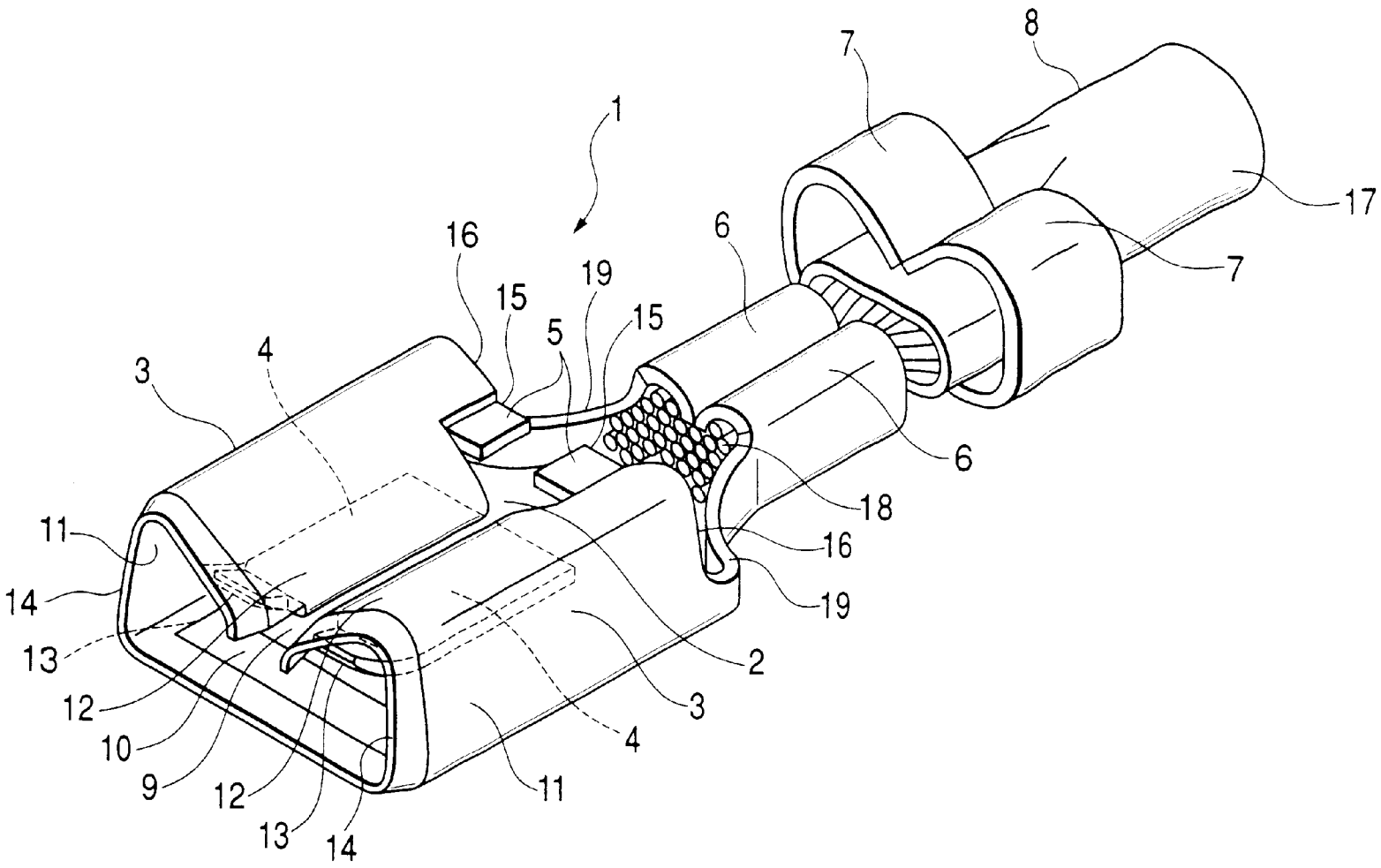
FIG. 1 is a perspective view showing one preferred embodiment of a terminal of the present invention.

In FIG. 1, the female terminal 1 is formed by pressing an electrically-conductive metal sheet a plurality of times. The terminal 1 includes a spatula-like base plate portion 2, a pair of resilient curl portions 3 and 3, a pair of electrical contact piece portions 4 and 4, a pair of retaining piece portions 5 and 5, a pair of conductor clamping portions 6 and 6, and a pair of sheath clamping portions 7 and 7. The portions 3, the portions 4 and the portions 5 are formed at a front portion of the base plate portion 2 whereas the portions 6 and the portions 7 are formed at a rear portion of the base plate portion 2.

The front portion of this terminal serves as an electrical contact portion for a mating male tab-like terminal (not shown), and the rear portion thereof serves as a wire connection portion for a wire 8, for example, of a vehicle's wire harness.

An electrical contact convex portion 9 is formed on the front portion of the base plate portion 2 by embossing, and bulges toward the resilient curl portions 3 and 3. The electrical contact convex portion 9 cooperates with the electrical contact piece portions 4 and 4 to hold the mating male tab-like terminal (not shown) therebetween. The electrical contact convex portion 9 has a tapering surface 10 formed over an entire periphery thereof, and a front portion of the tapering surface 10 can guide the mating male tab-like terminal (not shown) into a predetermined position.

The resilient curl portions 3 and 3 are integrally formed respectively on opposite side edges of the front portion of the base plate portion 2, and each curl portion 3 has a piece-like shape having a large width in a direction of extending of the base plate portion 2. This piece-like portion, forming the curl portion 3, is inwardly bent into a generally mountain-like cross-sectional shape. An outer slanting surface 11 of each resilient curl portion 3 is defined by an abruptly-slanting surface (because of the generally mountain-like cross-sectional shape) disposed almost perpendicularly to the base plate portion 2. On the other hand, an inner slanting surface 12 of each curl portion is defined by a gently-slanting surface much smaller in inclination than the outer slanting surface 11.

Each of the electrical contact piece portions 4 and 4 has a strip-like shape, and extends in the direction of extending of the base plate portion 2. The distal end portion of each resilient curl portion 3 is bent obliquely upwardly at a small angle to form the electrical contact piece portion 4. Front ends 13 and 13 of the electrical contact piece portions 4 and 4 are curved upwardly so as to guide the mating male tab-like terminal (not shown) into the predetermined position. The front ends 13 and 13 of the electrical contact piece portions 4 and 4 are disposed inwardly of front ends 14 and 14 of the resilient curl portions 3 and 3, respectively.

The pair of retaining piece portions 5 and 5 are integrally formed on the inner slanting portions (surfaces) 12 and 12 of the resilient curl portions 3 and 3, and each of the retaining piece portions 5 and 5 has a surface disposed parallel to a flat surface portion of the base plate portion 2. In other words, piece portions of a rectangular shape are stamped respectively from the inner slanting portions 12 and 12, and are arranged in a cantilever manner such that each of these piece portions has the surface parallel to the flat surface portion of the base plate portion 2. The retaining piece portions 5 and 5 are spaced at least from the flat surface portion of the base plate portion 2. One end 15 of each retaining piece portion 15, forming part of the contour thereof, is disposed in a plane, in which a rear end 16 of the resilient curl portion 3 (and hence a rear end of the inner slanting portion 12) lies, in continuous relation to this rear end 16.

Thus, the one end 15 of each of the retaining piece portions 15 and 15 is disposed in the plane, in which the rear end 16 lies, in continuous relation to the rear end 16, and with this construction the position of engagement of a retaining member 23 (described later; see FIG. 2) is the same as in the related construction. Therefore, the structure of the connector housing 20 (described later) does not need to be changed. And besides, the retaining piece portions 5 and 5 can be relatively easily formed integrally on the resilient curl portions, respectively (The retaining piece portions do not need to be bent, for example, as much as the electrical contact piece portions 4 and 4).

The retaining piece portions 5 and 5 do not need to be accurately parallel to the base plate portion 2 in so far as these retaining piece portions 5 and 5 can hold the elastically-deformed retaining member 23 (described later; see FIG. 2), engaged therewith, at a level (or height) spaced a desired distance from the base plate portion 2.

The pair conductor clamping portions 6 and 6 of a rectangular shape are integrally formed respectively on opposite side edges of a front section of the rear portion of the base plate portion 2, and serve to hold a conductor 18 (exposed by removing a sheath 17) of the wire 8 at an end portion thereof. The conductor clamping portions 6 and 6 are compressively deformed to hold the conductor 18.

Frame portions 19 and 19 of a small height are integrally formed respectively on the opposite side edges of the base plate portion 2, and each frame portion 19 extends between the conductor clamping portion 6 and the resilient curl portion 3.

The pair of sheath clamping portions 7 and 7 serve to hold the sheath 17 of the wire 8, and have a rectangular shape, and are larger in length than the conductor clamping portions 6 and 6. The sheath clamping portions 7 and 7 are integrally formed respectively on opposite side edges of a rear section of the base plate portion 2. The sheath clamping portions 7 and 7 are compressively deformed to hold the sheath 17, and the conductor 18, covered with the sheath 17, is compressed through the sheath 17.

Figure 2:
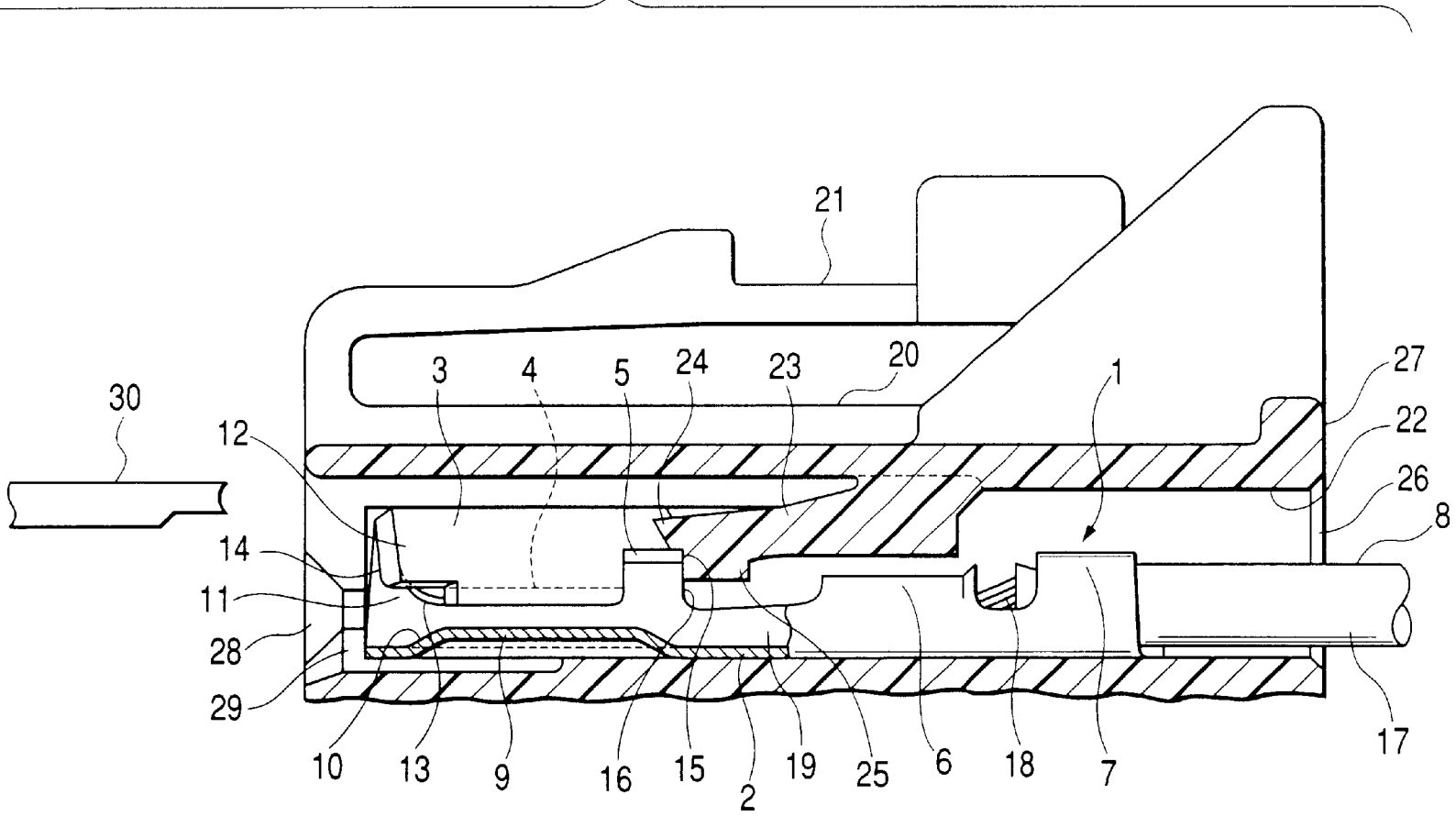
FIG. 2 is a cross-sectional view showing a condition in which the terminal is completely received in a connector housing.

In the above construction, as shown in FIG. 2, the terminal 1 is received in the connector housing 2 of a synthetic resin so as to be connected to the mating male tab-like terminal (not shown). In FIG. 2, the connector 21 comprises a plurality of terminals 1 (only one of which is shown), and the connector housing 20.

First, the construction of the connector housing 20 will be described briefly, and then the process of assembling the connector 21 will be described.

A plurality of (for example, corresponding in number to the terminals 1) terminal receiving chambers 22 (only one of which is shown) are formed in the connector housing 20. The retaining member 23 (often referred to as "lance") for engagement with the terminal 1 to prevent the withdrawal of the terminal from the terminal receiving chamber 22 is formed integrally within the terminal receiving chamber 22 in a projected manner. The retaining member 23 has an arm-like shape, and is elastic. A retaining projection portion 25 is formed on and projects from the retaining member 23, and is disposed adjacent to a distal end portion 24 of the retaining member 23. The retaining projection portion 25 is formed on that side of the retaining member 23 facing the terminal 1.

Reference numeral 26 denotes a terminal insertion port open to a rear end 27 of the connector housing 20. Reference numeral 28 denotes a connection port formed in a front wall 29 serving also as a stopper for the terminal 1. Reference numeral 30 denotes a lance displacement detection pin of a connector inspecting instrument.

In the above construction, for assembling the connector 21, the terminals 1 are inserted respectively into the corresponding terminal receiving chambers 22. When the terminal 1 is inserted into the terminal receiving chamber 22, the retaining member 23 is much elastically deformed by the resilient curl portions 3 and 3 (see FIG. 3). In this condition, when the terminal 1 is further inserted, so that the retaining piece portions 5 and 5 pass past the retaining projection portion 25 of the elastically-deformed retaining member 23, the retaining member 23 tends to be restored into its original position, and as a result the retaining member 23 engages the retaining piece portions 5 and 5. Namely, a corner portion, defined by the distal end portion 24 and the retaining projection portion 25 of the retaining member 23, is engaged with the one ends 15 and 15 of the retaining piece portions 5 and 5. At this time, the distal end portion 24 of the retaining member 23 rests on the retaining piece portions 5 and 5. The retaining member 23, when thus engaged with the terminal, is restored into a slightly elastically-deformed condition as compared with its original condition before the insertion of the terminal 1.

The completed connector 21 is inspected by the connector inspecting instrument so as to determine whether or not any of the terminals 1 is in a half-inserted condition.

When the terminal 1 is positively received in the terminal receiving chamber 22, the distal end portion 24 of the retaining member 23 is always held in the stable position by the retaining piece portions 5 and 5 (Since the retaining piece portions 5 and 5 are spaced the desired distance from the base plate portion 2 as described above, the position of the distal end portion 24 will not be varied by the condition of the resilient curl portions 3 and 3 and so on. Namely, this position will not be influenced by the adjustment of a contact load and so on. Therefore, the amount of displacement of the distal end portion 24 in the engaged condition is stable). Therefore, when the lance displacement detection pin 30 of the connector inspecting instrument is inserted into the terminal receiving chamber 22, this pin 30 will not abut against the retaining member 23, and the inspecting process can be carried out positively. When an electrical contact pin 31, shown in FIG. 3, is brought into contact with the terminal 1 to be electrically connected thereto, it is confirmed that the terminal 1 is positively received in the terminal receiving chamber.

Figure 3:
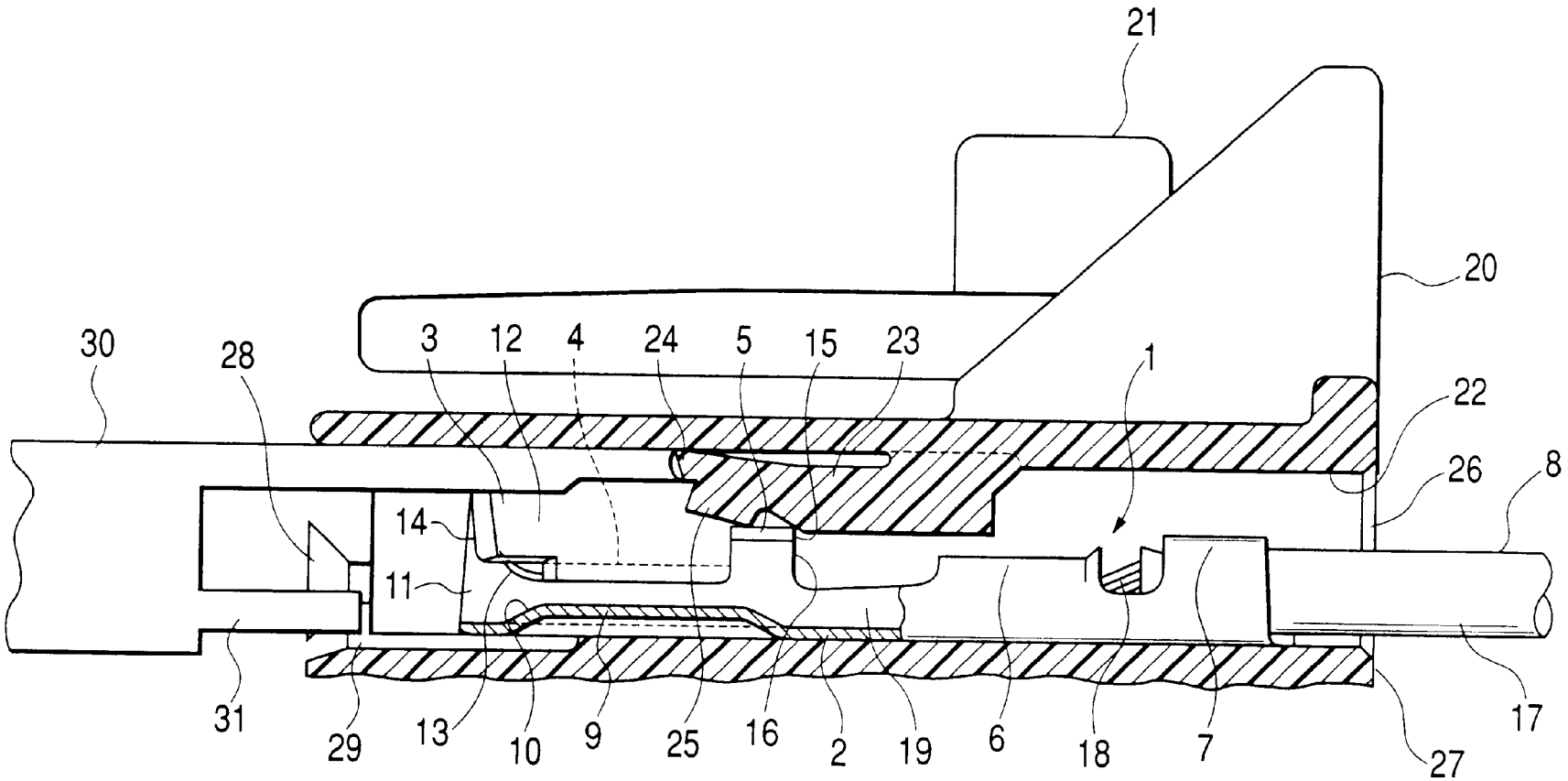
FIG. 3 is a cross-sectional view showing a condition in which the terminal is half inserted in the connector housing.

In FIG. 3, when the terminal 1 is in a half-inserted condition, the retaining member 23 is much elastically deformed, and is kept seated on the retaining piece portions 5 and 5. Therefore, when the lance displacement detection pin 30 is inserted into the terminal receiving chamber 22, this pin 30 is brought into abutting engagement with the retaining member 23, thereby detecting the half-inserted condition of the terminal. Namely, the electrical contact pin 31 is not brought into contact with the terminal 1, and hence is not electrically connected thereto, and therefore the half-inserted condition is detected.

As described above with reference to FIGS. 1 to 3, since the terminal 1 has the retaining piece portions 5 and 5, the amount of displacement of the retaining member 23 before and after the engagement is stabilized. By thus stabilizing the displacement amount, the detection of a half-inserted condition of the terminal 1 can be positively effected by the connector inspecting instrument.

Various modifications can be made without departing from the scope of the present invention.

Although the retaining piece portions 5 and 5 are spaced the desired distance from the base plate portion 2, these retaining piece portions 5 and 5 are so arranged as not to be caught by the retaining member 23 when the terminal 1 is inserted into the terminal receiving chamber 22.

As described above, in the present invention, when the terminal is received in the connector housing, the elastically-deformed retaining member engages the one ends of the retaining piece portions. Also, the retaining member rests on the surfaces of the retaining piece portions disposed parallel to the base plate portion. The retaining piece portions are spaced the desired distance from the base plate portion, and therefore the amount of displacement of the retaining member before and after the engagement with the retaining piece portions is stabilized. By thus stabilizing the displacement amount, the detection of a half-inserted condition of the terminal can be positively effected by the connector inspecting instrument.

Therefore, there is achieved an advantageous effect that there can be provided the terminal in which the amount of displacement of the elastically-deformed retaining member is stabilized.

In the present invention, the one end of each of the retaining piece portions and the rear end of the resilient curl portion are disposed in the common plane. Therefore, when the terminal is received in the connector housing, the position of engagement of the retaining member is the same as in the related construction.

Therefore, the structure of the connector housing does not need to be changed, and therefore there is achieved an advantageous effect that there can be provided the terminal of the better construction.

In the present invention, the one end of each of the retaining piece portions is continuous with the rear end of the resilient curl portion, and therefore the retaining piece portions can be relatively easily formed integrally on the resilient curl portions, respectively.

Therefore, there is achieved an advantageous effect that there can be provided the terminal of the better construction.

What is claimed is:

1. A metal terminal of a female type, comprising:

a base plate portion generally disposed in a first plane;

an electrical contact portion, to which a mating male terminal is connectable, formed on the base plate portion, the electrical contact portion including resilient curl portions which extend from opposite side edges of the base plate portion, and are inwardly bent to form curls thereof; and retaining piece portions integrally formed respectively on the resilient curl portions, the retaining piece portions having surfaces which are spaced from the base plate portion in generally parallel relation thereto, wherein one ends of the retaining piece portions, partially forming respective contours of the resilient curl portions, are engageable with a retaining member of a connector housing in which the terminal is receivable, wherein the one ends of the retaining piece portions and rear ends of the resilient curl portions are disposed in a common second plane substantially perpendicular to said first plane.

2. The terminal of claim 1, wherein the one ends of the retaining piece portions are continuous with the rear ends of the resilient curl portions.

3. The terminal of claim 1, wherein the mating male terminal is extended in the electrical contact portion from front ends toward rear ends of the resilient curl portions when connecting to the electrical contact portion.

4. The terminal of claim 1, wherein each of the resilient curl portions has a generally convex shape in a cross section thereof.

* * * * *